US005449089A

United States Patent [19]

Turner et al.

[11] Patent Number: 5,449,089

[45] Date of Patent: Sep. 12, 1995

[54] BELL FOUNTAIN CUP

[75] Inventors: Donald R. Turner, Shelbyville; Ronald L. Kennedy, Fishers, both of Ind.; Christopher C. Bidwell, Dunwoody, Ga.; Bruce A. Williams, Shelbyville, Ind.

[73] Assignee: Williams Industries, Inc., Shelbyville, Ind.

[21] Appl. No.: 190,277

[22] Filed: Feb. 2, 1994

[51] Int. Cl.[6] ..... B65D 1/42

[52] U.S. Cl. ..... 220/675; 220/DIG. 13; 220/703

[58] Field of Search ..... 229/1.5 B; 220/672, 220/675, 669, 703, 719, DIG. 12, DIG. 13

[56] References Cited

U.S. PATENT DOCUMENTS

| | | | |
|---|---|---|---|
| 3,194,468 | 7/1965 | Baron | 220/675 |
| 3,297,194 | 1/1967 | Schaper et al. | 220/672 |
| 3,825,145 | 7/1974 | Reynolds | 220/675 |
| 4,610,366 | 9/1986 | Estes et al. | 220/675 |
| 5,064,081 | 11/1991 | Hayashi et al. | 220/675 |
| 5,125,512 | 6/1992 | O'Leary | 229/1.5 B |

FOREIGN PATENT DOCUMENTS 448429 5/1949 Italy ..... 229/1.5 B

OTHER PUBLICATIONS

"ASB General", NISSEI ASB Machine Co., Ltd. catalog, Apr., 1991.

"One Stage Biaxial Orientation Stretch-Blow Molding Machine", ASB-32 Series, ASB-16 Series, NISSEI ASB Machine Co., Ltd. catalog No. 3022, 1991.

*Primary Examiner*—Stephen J. Castellano

*Attorney, Agent, or Firm*—Barnes & Thornburg

[57] ABSTRACT

A plastic bell fountain cup includes a bottom surface, and a side wall formed integrally with and extending upwardly from the bottom surface. The side wall has a lower portion adjacent the bottom surface, an upper lip portion defining a top opening of the cup, and a radially outwardly expanded portion located between the lower portion and the upper lip portion. The radially outwardly expanded portion has a maximum diameter larger than a diameter of the bottom surface and larger than a diameter of the top opening. The side wall has a substantially uniform thickness throughout the lower portion, the radially outwardly expanded portion, and at least a part of the upper lip portion.

4 Claims, 1 Drawing Sheet

BELL FOUNTAIN CUP

BACKGROUND AND SUMMARY OF THE INVENTION

The present invention relates to an improved bell fountain cup. More particularly, the present invention relates to a plastic bell fountain cup which is more visually appealing than prior art plastic bell fountain shaped cups.

Bell fountain cups have been known for many years. A bell fountain cup has a bottom surface and a side wall extending upwardly from the bottom surface. The side wall has a lower side wall portion located adjacent the bottom surface, a radially outwardly expanded or bell-shaped portion, and an upper lip portion which defines a top opening of the cup. The bottom surface has a diameter smaller than a diameter of the top opening. The radially outwardly expanded portion has a diameter larger than the top opening diameter. Therefore, the cup is generally bell-shaped. Traditionally, these bell fountain cups were made from glass. However, it is desirable to replicate these glass bell fountain cups using a plastic material.

Plastic bell fountain cups have been made using standard injection molding techniques. However, the use of standard injection molding techniques requires that the side wall thickness in the area of the radially outwardly expanded bell-shaped portion of the cup be substantially thicker than the side wall thickness in the upper lip portion of the cup in order to permit the cup to be removed from a standard injection mold. This thicker plastic material in the radially outwardly expanded portion of the cup makes the plastic cup formed using standard injection molding techniques less visually appealing than glass cups, especially in the area of the bell-shaped portion which has the increased plastic thickness. This disadvantage is especially noticeable for clear plastic cups.

Advantageously, the bell fountain cup of the present invention is made using an injection stretch blow molding apparatus. This injection stretch blow molding apparatus advantageously permits the cup to have a substantially uniform side wall thickness throughout the lower portion of the side wall, the radially outwardly expanded bell-shaped portion, and at least a part of the upper lip portion of the side wall. This improves the aesthetic qualities of the cup by providing a very clear plastic material throughout the plastic bell fountain cup. Advantageously, there is no build-up of plastic in the radially outwardly expanded bell-shaped portion of the improved bell fountain cup of the present invention.

According to one aspect of the present invention, a plastic bell fountain cup includes a bottom surface, and a side wall formed integrally with and extending upwardly from the bottom surface. The side wall has a lower portion adjacent the bottom surface, an upper lip portion defining a top opening of the cup, and a radially outwardly expanded portion located between the lower portion and the upper lip portion. The radially outwardly expanded portion has a maximum diameter larger than a diameter of the bottom surface and larger than a diameter of the top opening. The side wall has a substantially uniform thickness throughout the lower portion, the radially outwardly expanded portion, and at least a part of the upper lip portion.

In the illustrated embodiment, the side wall of the plastic bell fountain cup has a thickness of about 0.020 inch (0.508 mm). The side wall thickness varies by about +/−0.005 inch (0.127 mm) throughout the lower portion, the radially outwardly expanded portion, and at least said part of the upper lip portion. The side wall thickness varies by about +/−0.002 inch (0.0508 mm) in the radially outwardly expanded portion.

According to another aspect of the present invention, a method is provided for making a plastic bell fountain cup. The method comprising the steps of expanding a plastic preform in a mold using injection stretch blow molding to form a bottom surface, and a side wall formed integrally with and extending upwardly from the bottom surface. The side wall has a lower portion adjacent the bottom surface, an upper lip portion defining a top opening of the cup, and a radially outwardly extending portion located between the lower portion and the upper lip portion above the base. The radially outwardly expanded portion has a maximum diameter larger than a diameter of the bottom surface and larger than a diameter of the top opening. The side wall has a substantially uniform thickness throughout the lower portion, the radially outwardly expanded portion, and at least a part of the upper lip portion.

Another advantage of the present invention is that the use of an injection stretch blow mold method uses substantially less material than conventional injection molding methods. This results in a substantial cost savings. In the present invention, the side wall thickness is about 0.020 inch (0.508 mm). Injection molding methods require a side wall thickness of at least about 0.040 inch (1.016 mm) with a much thicker bulge area as discussed below.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
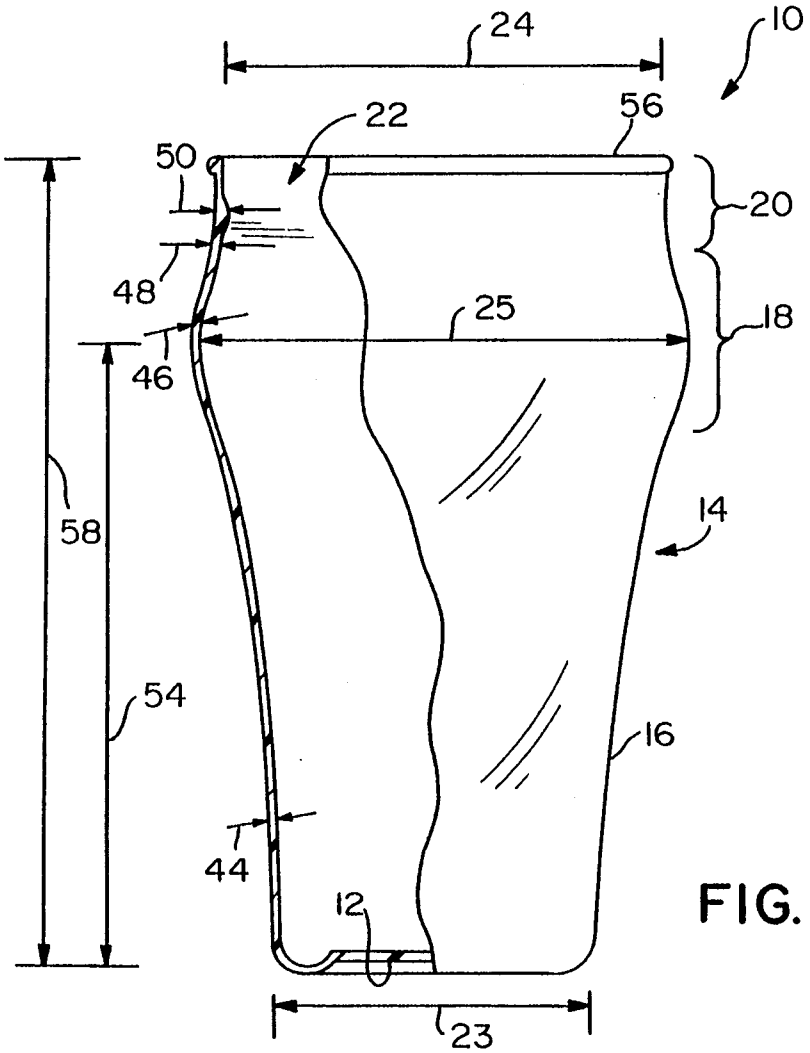
FIG. 1 is a partial sectional view taken through a plastic bell fountain cup of the present invention made using an injection stretch blow molding apparatus and method.

Referring now to the drawings, FIG. 1 illustrates an improved bell fountain cup 10 of the present invention. The bell fountain cup shape is a classic design which has been known for many years. Bell fountain cup 10 of the present invention is made from a plastic material such as PET or another suitable plastic resin. Bell fountain cup 10 includes a closed bottom 12 and a continuous side wall 14 having a lower portion 16 and a radially outwardly expanded bell-shaped portion 18. Bell fountain cup 10 further includes an upper lip portion 20 defining top opening 22.

Bell fountain cup 10 is characterized in that a diameter of bottom surface illustrated by dimension 23 is less than a diameter of top opening 22 illustrated by dimension 24. A diameter of cup 10 in radially outwardly expanded portion 18 illustrated by dimension 25 is greater than the diameter 24 of top opening 22. This unique shape provides the appearance of a bell.

Figure 2:
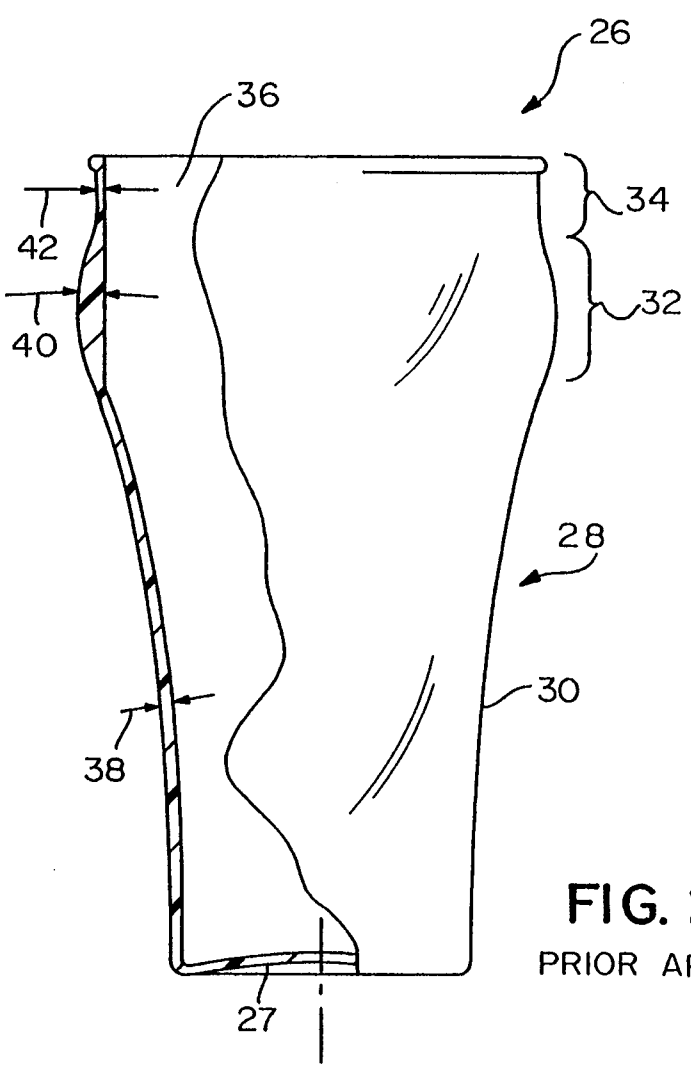
FIG. 2 PRIOR ART
FIG. 2 is a partial sectional view taken through a prior art plastic bell fountain cup made using a standard injection molding apparatus and method.

One prior art bell fountain cup is illustrated in FIG. 2. Bell fountain cup 26 illustrated in FIG. 2 is made from a plastic material using a standard injection molding technique. Bell fountain cup 26 includes a bottom surface 27, and a side wall 28 having a lower portion 30, a bell-shaped portion 32, and an upper lip portion 34 defining a top opening 36. Side wall 28 has a first side wall thickness illustrated by dimension 38 in lower portion 30. Illustratively, side wall thickness 38 is about 0.040 inch (1.016 mm). The thickness of side wall 28 in the bell-shaped radially outwardly expanded portion 32 is illustrated by dimension 40. The thickness of side wall 28 in upper lip portion 34 is illustrated by dimension 42. Dimension 40 is substantially larger than dimensions 38 or 42. When using standard injection molding techniques, the thickness of the plastic material forming side wall 18 in the radially outwardly expanded bell-shaped portion 32 must be greater than the thickness of upper lip portion 34 in order to permit removal of bell fountain cup 26 from the injection mold (not shown). This increased thickness in radially outwardly expanded bell-shaped portion 32 is often unsightly and detracts from the aesthetic quality of cup 26.

Advantageously, the side wall 14 of bell fountain cup 10 of the present invention has substantially a uniform side wall thickness throughout lower portion 16, radially outwardly expanded bell-shaped portion 18, and at least a part of upper lip portion 20 as illustrated in FIG. 1. Lower portion 16 of side wall 14 has a thickness illustrated by dimension 44. Radially outwardly expanded bell-shaped portion 18 has a thickness illustrated by dimension 46. Upper lip portion 20 has a first thickness illustrated by dimension 48 in a part of upper lip portion located adjacent radially outwardly expanded portion 18. Lip portion 20 also has an area of increased thickness 50 located near top edge 56 of cup 10 due to the use of a parison or preform to form cup 10.

Preferably, the side wall thickness (44, 46, 48) is about 0.020 inch (0.508 mm) in thickness. This provides a substantial cost and material savings due to the reduced side wall thickness compared to conventional injection molded cups. The thickness 46 within radially outwardly expanded portion 18 preferably has a tolerance of about +/−0.002 inch (0.0508 mm). The overall tolerance for side wall thickness (44, 46, 48) from lower portion 16, radially outwardly expanded bell-shaped portion 18, and at least a portion of upper lip portion 20 is about +/−0.005 inch (0.127 mm). It is understood that the thickness of portion 50 may be thicker than the remainder of side wall 14 due to the use of a preform in the injection stretch blow molding technique of the present invention.

By providing a substantially uniform side wall thickness, the bell fountain cup 10 of the present invention advantageously provides a more visually appealing cup than the prior art cup illustrated in FIG. 2. This is especially noticeable in the radially outwardly expanded bell-shaped portion 18. Because side wall 14 has a substantially uniform thickness through radially outwardly expanded portion 18, cup 10 is very clear or transparent in the radially outwardly expanded portion 18.

The bell fountain cup 10 illustrated in FIG. 1 is a 20 ounce cup. Illustratively, for a 20 ounce cup, the outer diameter of bottom surface 12 illustrated by dimension 23 is about 2.363 inches (60.02 mm). Inner diameter of top opening 22 illustrated by dimension 24 is about 3.250 inches (82.55 mm). The maximum diameter of radially outwardly expanded portion 18 illustrated by dimension 25 is about 3.631 inches (92.22 mm). The distance from bottom surface 12 to the maximum diameter location of radially outwardly expanded portion 18 as illustrated by dimension 54 is about 4.688 inches (119.08 mm). The distance from bottom surface 12 to top edge or lip 56 of cup 10 illustrated by dimension 58 is about 6.059 inches (153.90 mm). It is understood that these dimensions will vary proportionally as the size of bell fountain cup 10 changes. Advantageously, lip 56 of cup 10 is somewhat rounded and smooth due to the formation of cup 10 by the injection stretch blow mold method discussed below. This provides an advantage over cups made by an extrusion blow method which requires the lip area of the cup to be trimmed, leaving a sharp and potentially dangerous lip edge.

An injection stretch blow molding apparatus (not shown) and method is used to form bell fountain cup 10 of the present invention. Illustratively, the injection stretch blow molding apparatus is an ASB machine available from Nissei ASB Machine Co. Ltd of Japan. It is understood, however, that other such apparatus may be used to make bell fountain cup 10 of the present invention.

Using the injection stretch blow molding apparatus and method, a parison or preform is first injection molded. The preform is then temperature conditioned or selectively heated and moved to a blow station. The preform is then stretched lengthwise and a large volume of air is blown into it to form bell-shaped cup 10 at the blow station. In other words, the plastic material of the preform expands outwardly due to the air pressure to conform to the shape of a mold and form bell fountain cup 10. From the blow station, cups 10 move to an ejection station where the finished cups 10 are ejected from the apparatus.

Although the invention has been described in detail with reference to a certain preferred embodiment, variations and modifications exist within the scope and spirit of the invention as described and defined in the following claims.

What is claimed is:

1. A plastic bell fountain cup comprising a bottom surface having a predetermined diameter, and a side wall formed integrally with and extending upwardly from the bottom surface, the side wall having a lower portion adjacent the bottom surface, an upper lip portion defining a top opening having a diameter larger than the diameter of the bottom surface, and a radially outwardly expanded portion located between the lower portion and the upper lip portion, the radially outwardly expanded portion having a maximum diameter larger than the diameter of the top opening, the side wall having a substantially uniform thickness of about 0.020 inch, the side wall thickness varying by only about +/−0.005 inch throughout the lower portion, the radially outwardly expanded portion, and at least a part of the upper lip portion.

2. The plastic bell fountain cup of claim 1, wherein the side wall thickness varies by about +/−0.002 inch in the radially outwardly expanded portion.

3. The plastic bell fountain cup of claim 1, wherein the cup is made from PET.

4. The plastic bell fountain cup of claim 1, wherein the cup is formed by an injection stretch blow molding method.

* * * * *